US006416100B1

(12) United States Patent
Sting et al.

(10) Patent No.: US 6,416,100 B1
(45) Date of Patent: Jul. 9, 2002

(54) GRIPPER MECHANISM FOR DEVICE FOR HANDLING OBJECT IN THE FORM OF SHEETS OR PLATES, IN PARTICULAR FOR POST PROCESSING MACHINE

(75) Inventors: Martin Sting, Bad Vilbel; Christian Botschek, Rodermark; Rainer Oberheim, Bensheim, all of (DE)

(73) Assignee: Pitney Bowes Technologies GmbH, Friedberg (DE)

( * ) Notice: Subject to any disclaimer, the term of this patent is extended or adjusted under 35 U.S.C. 154(b) by 0 days.

(21) Appl. No.: 09/592,959

(22) Filed: Jun. 13, 2000

(30) Foreign Application Priority Data

Jun. 17, 1999 (DE) ..... 199 27 728

(51) Int. Cl.[7] ..... B66C 1/48

(52) U.S. Cl. ..... 294/102.1; 294/103.1

(58) Field of Search ..... 294/16, 62, 63.1, 294/67.33, 81.6, 81.62, 101, 102.1, 103.1, 104, 114, 116, 119.1, 901

(56) References Cited

U.S. PATENT DOCUMENTS 4,697,246 A * 9/1987 Zemke et al. ..... 364/563
5,704,246 A * 1/1998 Kruger ..... 73/159
5,893,595 A * 4/1999 Corbett ..... 294/102.1
5,975,514 A * 11/1999 Emigh et al. ..... 270/58.06

* cited by examiner

*Primary Examiner*—Robert E. Pezzuto
(74) *Attorney, Agent, or Firm*—George M. Macdonald; Angelo N. Chaclas

(57) ABSTRACT

In a gripper mechanism for devices for handling objects in the form of sheets or plates, simple and easy operability of the gripper claws of pivoting gripper arms into the open position for adjustment purposes, test purposes and the like is achieved in that a manual operating element made of plastic is connected in the gripper claw operating drive between an operating lever which is mounted on the relevant gripper arm such that it can pivot, and a coupling linkage which is connected to one of the gripper claws which can pivot, and this manual operating element can pivot on the operating shaft of the gripper claw operating drive in such a manner that the claw can be caused to open easily while the machine is at rest, without any risk of injuries.

9 Claims, 4 Drawing Sheets

GRIPPER MECHANISM FOR DEVICE FOR HANDLING OBJECT IN THE FORM OF SHEETS OR PLATES, IN PARTICULAR FOR POST PROCESSING MACHINE

TECHNICAL FIELD

The invention relates to a gripper mechanism for devices for handling objects in the form of sheets or plates, in particular for post processing machines.

BACKGROUND ART

Generally known gripper mechanisms of this type, which have been in use for a long time, contain a gripper arm which can pivot about a gripper arm pivoting shaft, which gripper arm can be moved transversely with respect to the movement direction of a transfer chain, which is driven intermittently for example, by means of an appropriate drive, for example a crank drive, to carry out reciprocating pivoting movements. At its free end, the gripper arm is fitted with a gripper hand which has a pair of interacting gripper claws of which, in general, one is designed to be fixed relative to the gripper arm and the other is fitted such that it can pivot relative to the gripper arm. The pivoting gripper claw is moved by means of a claw operating drive against the force of spring means, which hold the gripper claws in the closed position, in specific pivoting positions of the gripper arm to the open position in order to grip either a specific object in the form of a sheet or plate, or a corresponding stack of such objects, and once the gripper claws have closed, to transport them to the transfer chain or else, when this handling process has been completed, to release the relevant object or stack of objects once again so that the compartment on the transfer chain which has now been filled can continue to move with said chain. One known embodiment of a gripper claw operating drive provides an operating lever arrangement which is mounted on the gripper arm such that it can pivot, can be pivoted by means of a claw operating drive apparatus during the pivoting movements of the relevant gripper arm, and is connected via a coupling linkage to the gripper claw which can pivot with play or a clearance which allows a specific opening of the gripper claws against the force of the spring prestressing means regardless of the respective position of the operating lever arrangement. In general, the operating lever arrangements for a plurality of gripper arms which are operated at the same time and are forced to move synchronously in a reciprocating manner are seated on a common operating shaft which is mounted on each of the simultaneously moved gripper arms, and is rotated in a reciprocating manner in specific gripper arm pivoting positions via a slotted guide link, a slotted guide link feeler and a feeler roll lever, which is firmly attached to the operating shaft, in order to operate the respective pivoting gripper claws on the individual gripper arms simultaneously, so that the operating lever arrangements which are seated on the operating shaft move the moving gripper claws to the open position via the individual coupling linkage.

When a post processing machine is being prepared for a specific operating sequence, the gripper claws in the individual workstations are thus set to the thickness of the object to be handled or to the thickness of the stack of objects to be handled. In this case, the gripper claws associated with a gripper arm have to be moved by hand to the open position at the individual workstations. Since the prestressing means or spring means which force the gripper claw pairs into their closed position now exert considerable mechanical forces in order to allow the objects to be handled to be gripped and fixed securely, an operator faces difficulties, when preparing the machine for an operation or when setting and servicing the machine, into applying sufficient forces by hand at any point in the gripper claw operating drive or the gripper claw operating mechanism in order to overcome the force of the prestressing means. If a forceful attempt is made, parts of the post processing machine may be damaged. In particular, however, there is a risk of injuries and, furthermore, problems with manual operation become particularly difficult when the gripper claw operating drives for a series of gripper claw pairs are coupled via a common operating shaft which covers a plurality of workstations, so that the prestressing means provided on a relatively large number of gripper arms have to be overcome jointly in order to open one entirely specific gripper claw or one specific gripper claw pair.

DISCLOSURE OF THE INVENTION

The invention is intended to achieve the object of refining a gripper mechanism having the features of the precharacterizing clause of the attached Claim 1 so as to provide a simple capability, which reduces the risk of injury, for manual operation of the gripper claw pair or of a gripper arm. This object is achieved according to the invention by the features specified in the characterizing part of Claim 1. Advantageous refinements and developments of the gripper mechanism specified here also form the subject-matter of the patent claims which are dependent on Claim 1 and whose content is in consequence expressly made part of the description without having to repeat the wording at this point.

It is self-evident that the design of a gripper mechanism as specified here also achieves the aim, by means of a single component which has a very simple design and is cheap, particularly if it is made of plastic, not only of achieving the object described above but of improving the smooth running and wear resistance of such a gripper mechanism, since the manual operating part specified here also acts as a bearing component. It is also particularly advantageous that, in a gripper mechanism of the type specified here, the gripper claws on a specific gripper arm of a post processing machine can be opened by means of the respective manual operating element without the gripper claws on adjacent gripper arms also being opened and without having to overcome the prestressing force of more than only the prestressing means which are associated with just the relevant one gripper arm. A number of embodiments will be explained in more detail in the following text with reference to the drawings, in which:

DETAILED DESCRIPTION OF THE INVENTION

Figure 1:
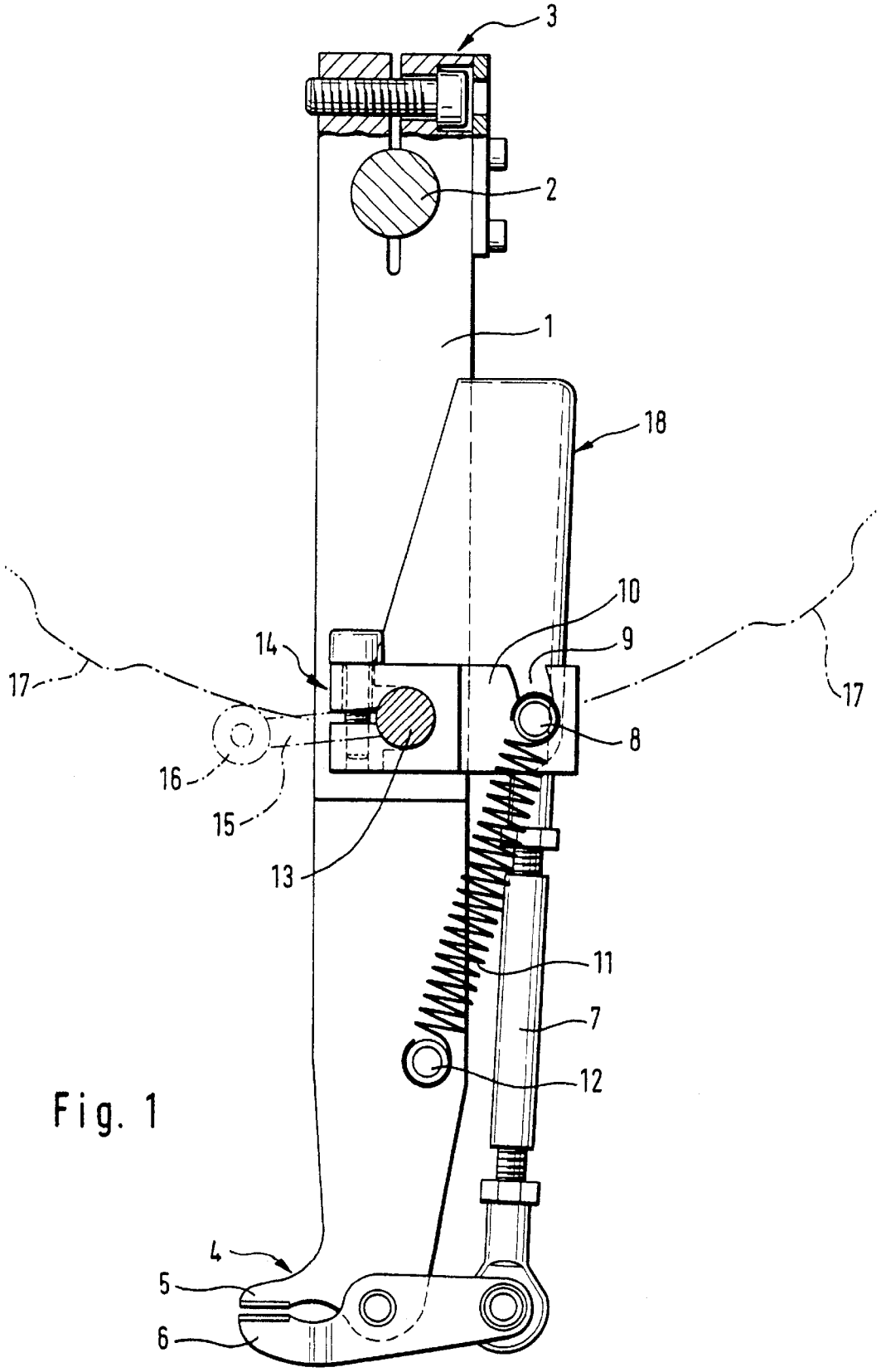
FIG. 1 is a schematic side view, drawn partially in section, of the most important parts of a first embodiment of a gripper mechanism of the type specified here.

In FIG. 1, major parts of a gripper mechanism of the type specified here are shown in a side view, and partially in section. The gripper mechanism includes a gripper arm 1 whose upper end is coupled to a gripper arm pivoting shaft 2 such that they rotate together. In the illustrated embodiment, the gripper arm 1 is clamped onto the gripper arm pivoting shaft 2 by means of a clamping mechanism 3. The gripper arm pivoting shaft can be driven to carry out oscillating rotary movements by means of a pivoting drive, which is not shown in FIG. 1, so that the gripper arm 1 carries out reciprocating pivoting movements about the gripper arm pivoting axis of the pivoting shaft 2, as is known for gripper mechanisms of the general type under discussion here.

At the lower end of the gripper arm 1 there is a gripper hand 4, which is provided with an upper gripper claw 5 fixed firmly to the gripper hand 4, and with a lower gripper claw 6 fitted to the gripper hand 4 such that it can pivot. The claw 6, which can pivot relative to the gripper hand 4, is connected to the lower end of the coupling linkage 7, whose upper end is attached to a shaft 8. The ends of the shaft 8, which project beyond the connecting point of the coupling linkage 7 at the sides, are each inserted into bearing recesses 9, which are approximately U-shaped or in the form of circle sectors, of operating levers 10 of an operating lever arrangement, and are also used as tension spring anchor points for helical tension springs 11 which are stretched to further spring anchor points on both sides of the gripper arm 1. The further spring anchor points are indicated at 12 in FIG. 1 and are located on the gripper arm sides close to the gripper hand 4.

The operating levers 10 are mounted on a gripper claw pivoting shaft 13, for which purpose each of the operating levers 10 are provided with a clamping apparatus, which is indicated schematically at 14 in FIG. 1. The gripper claw pivoting shaft 13 is mounted in the gripper arm 1 such that it can rotate. If there are a number of gripper mechanisms of the type specified here alongside one another in workstations arranged successively along a transfer chain in a post processing machine, then the gripper claw pivoting shaft 13 for a plurality of gripper mechanisms is provided jointly and is in each case mounted in the gripper arms 1 such that it can rotate.

Apart from the operating levers 10, a slotted-link feeler lever 15 with a slotted link feeler roll 16 is mounted on the gripper claw pivoting shaft 13. The slotted link feeler roll 16 interacts with a slotted guide link during the pivoting movements of the gripper arm 1, this slotted guide link being fixed to the framework and being symbolized by a dash-dotted line in FIG. 1. Pivoting movements of the slotted link feeler lever 15 anticlockwise about the axis of the gripper claw pivoting shaft 13 likewise result in the operating levers 10 being pivoted anticlockwise and the shaft 8 and the coupling linkage 7 being raised in the process, so that the gripper claw 6, which can pivot, is opened against the prestressing force of the helical tension springs 11 in order to release objects to be handled which are clamped in between the gripper claws of the gripper hand 4, or to receive such objects, which are then clamped in by means of the gripper claws.

The slotted bearing recesses 9 in the operating levers 10 result in the operating levers 10 being connected with play and via the coupling linkage 7 to the pivoting gripper claw, and this play allows the gripper claws to open to a certain extent against the force of the prestressing means irrespective of the position of the operating levers 10 and irrespective of the instantaneous operating position of the gripper arm, in order that objects of different thickness can be clamped in between the gripper claws 5 and 6.

Figure 2:
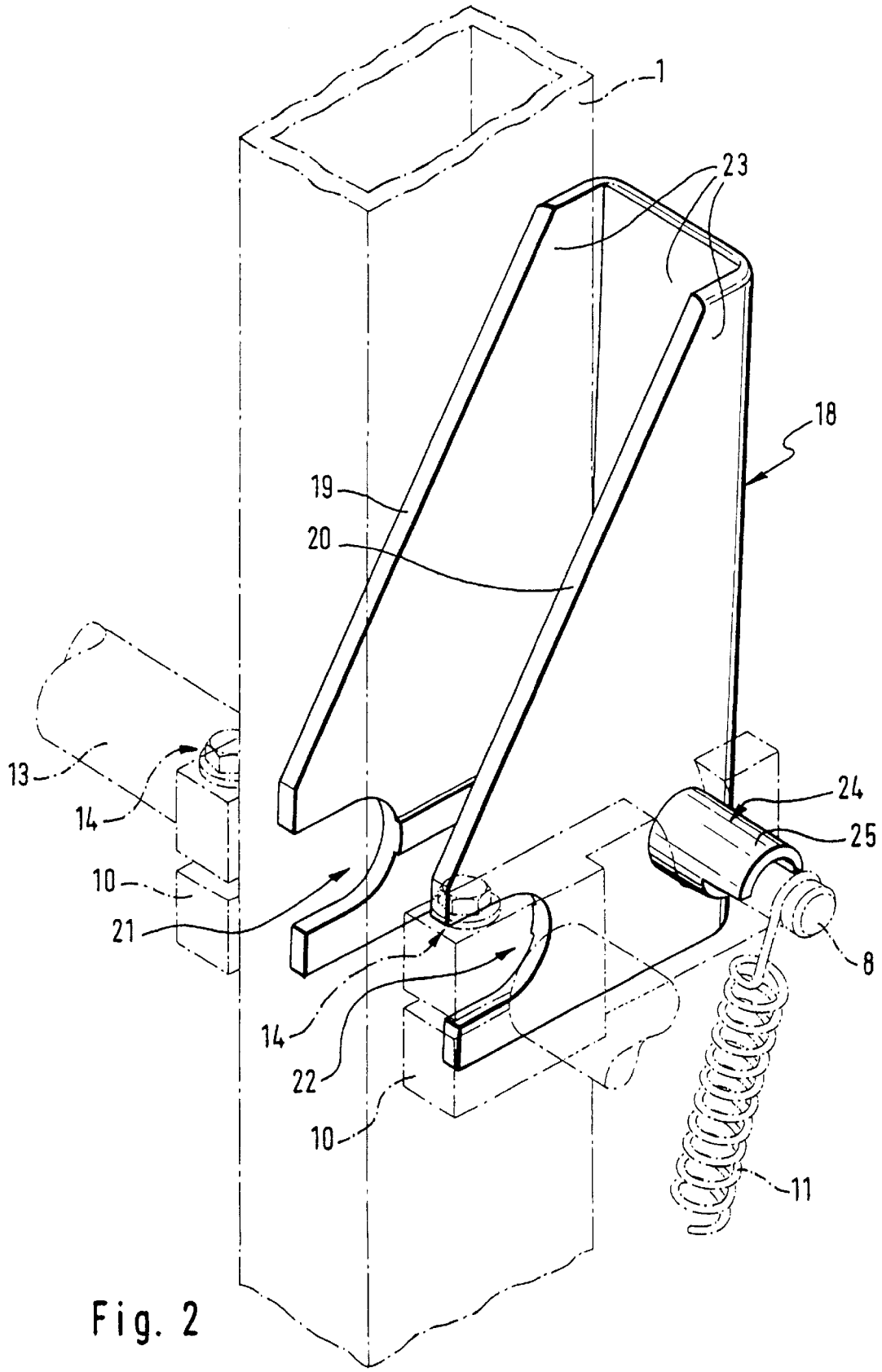
FIG. 2 shows a perspective view of a manual operating element of the gripper mechanism shown in FIG. 1 while at the same time indicating specific parts of this gripper mechanism by means of dashed-dotted lines.

In order to move the pivoting gripper claw 6 against the prestressing force of the prestressing springs 11 to the open position during adjustment work, servicing work and test work, particularly in order to check that the gripper claws clamp in objects to be handled which are in the form of sheets or plates, before the normal operating sequence in a system, a manual operating element 18 is provided in the gripper mechanism of the type specified here, and its detailed design can be seen clearly in FIG. 2.

The manual operating element 18 has two bearing side pieces 19 and 20 which are directly axially adjacent to the operating levers 10 with respect to the geometric pivoting axis of said operating levers 10, which bearing side pieces 19 and 20 (in the illustrated embodiment) engage around the gripper arm 1 at the sides and, in the region of the U-shaped bearing recesses 21 and 22, respectively, are placed like shim plates between in each case one operating lever 10 and the adjacent side wall of the gripper arm. The bearing recesses 21 and 22 are used to hold the gripper claw operating shaft 13. Apart from the bearing side pieces 19 and 20, the manual operating element 18 has a handling attachment 23 which is formed by a connecting web between the bearing side pieces and by inclined attachments on these bearing side pieces, in the manner which can be seen in FIGS. 1 and 2. It can be seen from FIGS. 1 and 2 that the manual operating element 18 matches the shape of the gripper arm 1 and is arranged close to the gripper arm so that no projecting parts of the manual operating element need to be fixed during operation.

The bearing side pieces 19 and 20 of the manual operating element 18 are provided at a radial distance from the bearing recesses 21 and 22 with sleeves 24 which project at the sides with respect to the gripper claw operating shaft 13, through which sleeves 24 there are bearing holes to hold the shaft 8. The external diameter of the sleeves 24 is matched to the width of the slotted bearing recesses 9 in the operating levers 10. The sleeves 24 thus act like a bearing bush between the shaft 8 that is fitted to the upper end of the coupling linkage 7, and the bearing recesses in the operating levers 10. Sleeve attachments 25 extend beyond the side boundary surface of the respective operating lever 10 and act as spacers for the shaft 8 by virtue of the sleeve attachments 25 interacting with the spring anchorage of the ends of the helical tension springs 11, which are each inserted into an annular groove at the end of the shaft 8.

For dismantling, the helical tension springs 11 are detached from the shaft 8. The shaft 8 is separated from the coupling linkage 7, from the manual operating element 18 and from the operating levers 10 by pushing it out axially. The manual operating element 18 can then easily be removed from the gripper arm 1, and using its bearing side pieces 19 and 20, can be pulled out from the spaces between the operating levers 10 and the side surfaces of the gripper arm 1. The assembly procedure is carried out in the corresponding reverse sequence.

In the described exemplary embodiment, the manual operating element 18 is manufactured from a high-strength, tough plastic. It can easily be made as an injection moulded part. It is comparatively cheap to produce and improves the smooth running and wear resistance of the gripper mechanism specified here.

When the manual operating element 18 on a gripper arm is operated, only the pivoting gripper claw 6 which is associated with this gripper arm is opened and only the prestressing forces of the prestressing helical springs 11 on this gripper arm need be overcome for this purpose.

Figure 3:
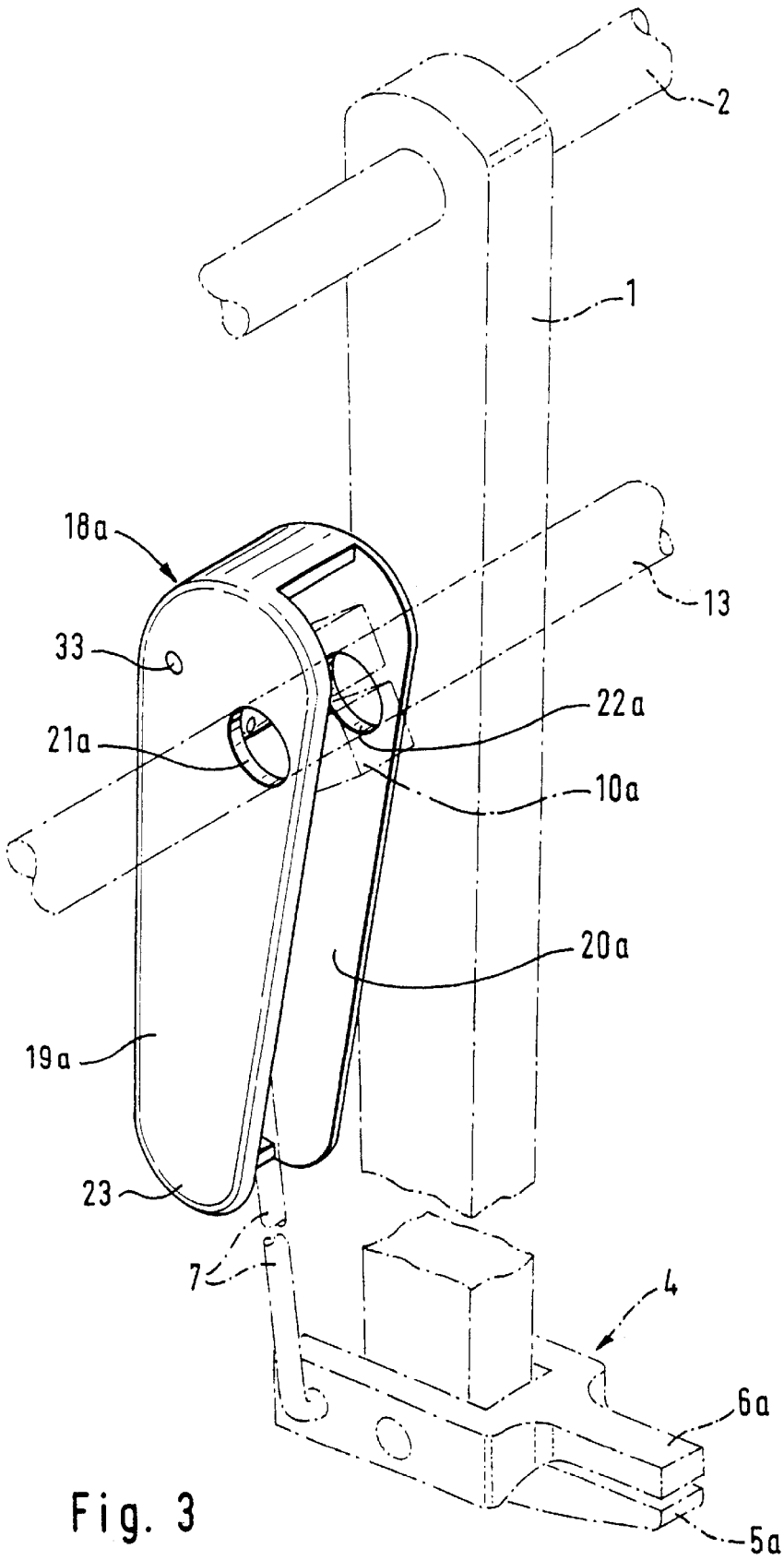
FIG. 3 shows a perspective view of a manual operating element for another embodiment of a gripper mechanism of the type specified here, indicating specific parts of this gripper mechanism by means of dashed-dotted lines.
Figure 4A:
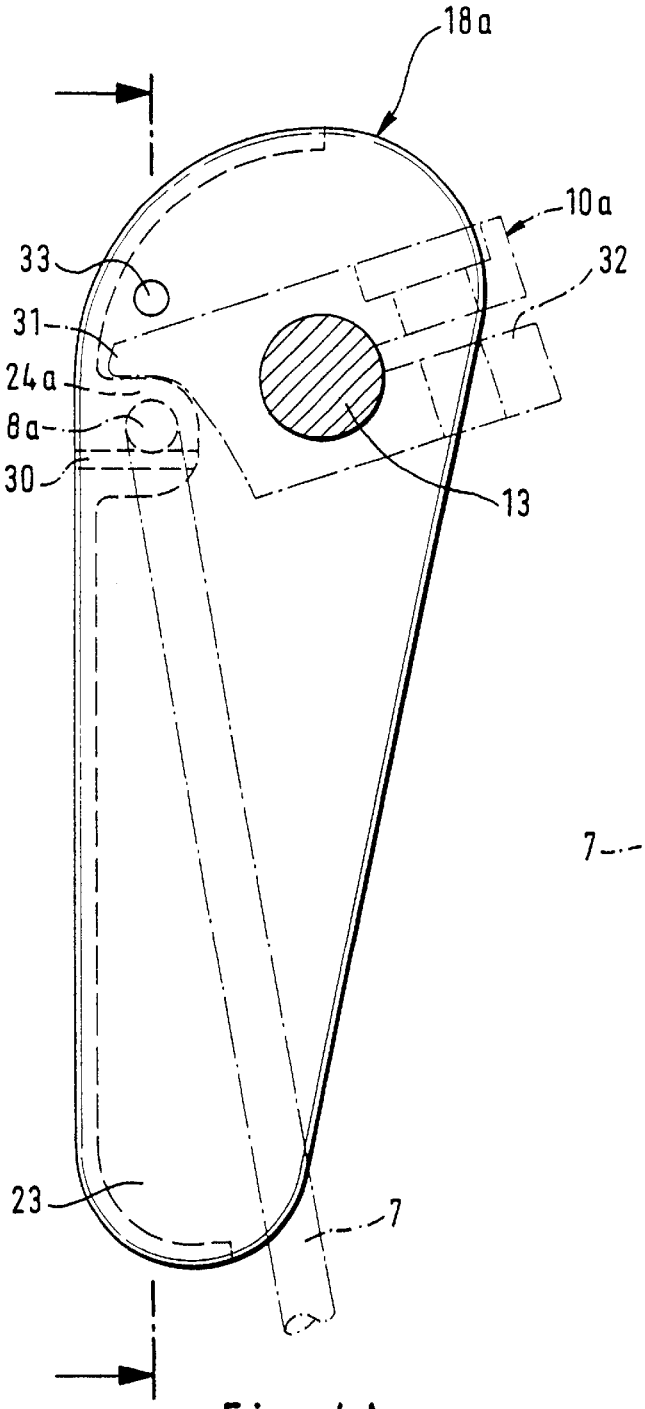
FIGS. 4A and 4B show a side view and a sectioned front view of a manual operating element of the gripper mechanism shown in FIG. 3.
Figure 4B:
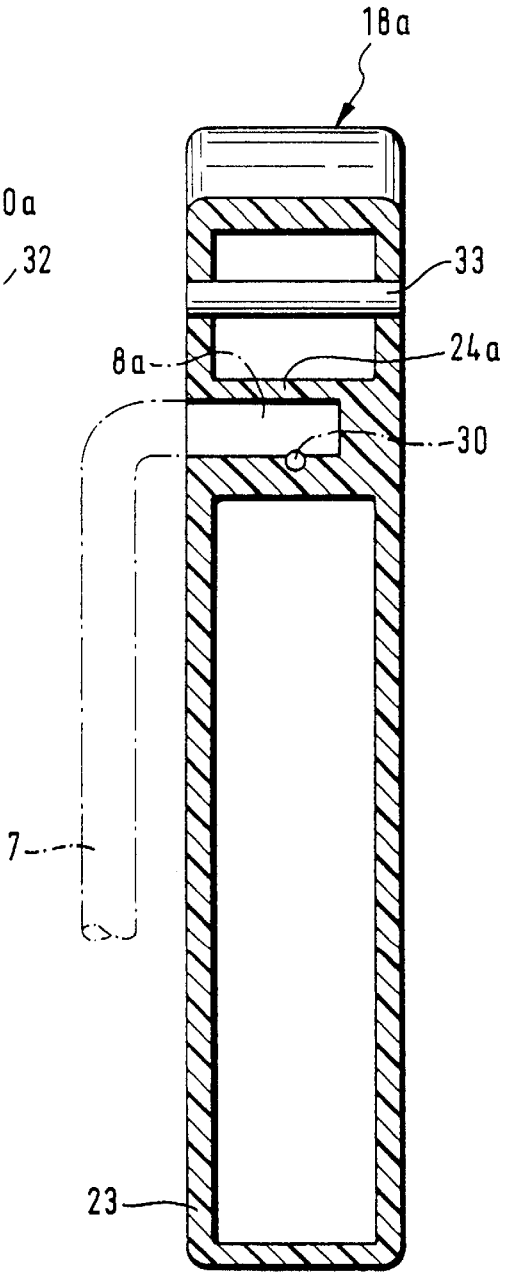

In FIGS. 3 to 4B, which show a further embodiment of major parts of a gripper mechanism of the type specified here, parts which correspond to those in the embodiment shown in FIGS. 1 and 2 are denoted by the same reference symbols. The gripper arm 1, which can be pivoted about the gripper arm pivoting axis of the gripper arm pivoting shaft by means of a pivoting drive which is not shown in FIG. 3, is fitted on its gripper hand 4 which is provided at the free gripper arm end with an upper pivoting gripper claw 6*a* and with a lower gripper claw 5*a* which interacts with it and is firmly attached to the gripper hand. The upper, pivoting gripper claw 6*a* is prestressed by the prestressing spring means (which are not shown in the drawing) in the closing direction against the lower gripper claw 5*a*, which is fixed relative to the gripper hand 4.

A coupling linkage 7 is coupled to a rearward attachment on the gripper claw 6*a*. This coupling linkage 7 is guided such that it runs upwards approximately in the direction of the gripper arm to a shaft 8*a*, which runs parallel to the gripper arm pivoting axis and, in the illustrated embodiment, merges directly into this shaft stub.

An operating shaft which is denoted by 13 here is mounted in bearings which are oriented with their axis parallel to the gripper arm pivoting axis and are each provided on one gripper arm between its ends, for pivoting jointly with the gripper arms, which operating shaft is a component of a gripper claw operating drive in a similar way to that in the embodiment described above and, in certain pivoting positions of the gripper arm or of the gripper arms is twisted via a slotted guide link which is fixed to the framework, via a slotted link feeler member and a slotted link feeler lever which is seated on the operating shaft 13 such that they rotate together, such that an operating lever 10*a* which is in each case mounted on the operating shaft 13 in the vicinity of the associated gripper arm 1 for its part carries out pivoting movements, in certain pivoted positions of the gripper arm, in order to operate the gripper claw 6*a* via the coupling linkage 7.

The shaft stub 8*a* which is fitted to the upper end of the coupling linkage 7 is coupled to the operating lever 10*a* via the manual operating element 18*a* in the manner described in the following text.

The manual operating element 18*a* has side bearing side pieces 19*a* and 20*a* which are provided with bearing recesses in the form of bearing holes 21*a* and 22*a*, respectively, through which the operating shaft 13 passes. The bearing side pieces 19*a* and 20*a* of the manual operating element 18*a*, seated on the operating shaft 13, engage around the operating lever 10*a*.

Furthermore, a bearing sleeve 24*a* extends from one bearing side piece to the other in the space located between the bearing side pieces of the manual operating element 18*a*, as can be seen in FIGS. 4B and 4B. In the region of this sleeve, the manual operating element 18*a* is provided with a blind hole into which the shaft stub 8*a*, which is fitted to the top of the coupling linkage 7 and runs parallel to the shaft 13, is inserted and is secured by means of a pin 30, as a person skilled in the art can see from the illustration in FIGS. 4A and 4B. The sleeve region 24*a* at the same time forms a jacket for the shaft stub 8*a*, on which a projecting attachment 31 on the operating lever 10*a* acts when the operating shaft 13 pivots and, in the process, forces the coupling linkage 7 downwards from the position at the instant shown in FIG. 3, in order to move the pivoting gripper claw 6*a* to the open position.

The position of the manual operating element 18*a* along the operating shaft 13 is fixed by the associated operating lever 10*a* mounted on the shaft 13, with the operating lever 10*a* being provided with a clamping apparatus 32 which is indicated schematically in FIG. 4A.

In the embodiment shown in FIGS. 3 to 4B, the manual operating element is once again a plastic moulding or injection moulded part composed of tough, hard plastic, which is provided with a handling attachment 23 and makes it considerably easier to move a pivoting gripper claw to the open position by hand. Clearance within the gripper claw operating drive, such that the gripper claws can be moved for test purposes to the open position irrespective of the instantaneous operating state of the gripper claw operating drive and irrespective of the instantaneous pivoted position of the gripper arm, can be achieved in the most recently described embodiment between the projecting attachment 31 on the operating lever 10*a* and the outer surface of the sleeve region 24*a* and can be limited by a stop pin 33 which runs parallel to the shaft stub 8*a* between the retaining side pieces 19*a* and 20*a*.

What is claimed is:

1. A gripper mechanism for devices for handling objects in the form of sheets or plates, in particular for post processing machines, comprising:

a gripper arm which can pivot about a pivot axis on a gripper arm pivoting shaft, the gripper arm having a pivot end for pivoting about the pivot axis and a free gripper arm end;

a pivoting drive which is coupled to the gripper arm;

a gripper hand which is located at the free gripper arm end, the gripper hand having a pair of interacting gripper claws having a first gripper claw member attached to the gripper hand and a second gripper claw member pivotally attached to the gripper hand, wherein the second gripper claw member cooperates with the first gripper claw member for handling an object, the second gripper claw member having a gripper claw pivoting shaft for pivoting about a gripper claw pivot axis for pivoting into a plurality of positions including pivoting in an opening direction to an open position and pivoting in a closing direction to a closed position;

prestressing means for initially clamping the second gripper claw member in the closed position; and a gripper claw operating drive operatively connected to the second gripper claw member for pivoting the second gripper claw member about the gripper claw pivoting shaft, which is parallel to the gripper arm pivoting shaft, in the opening direction against the force of the prestressing means;

wherein the gripper claw operating drive includes a first operating lever having a first side and a second side which is mounted on the gripper arm such that it can be pivoted by a claw operating drive apparatus about an operating shaft during the pivoting movements of the gripper arm, and is connected via a coupling linkage to the second gripper claw member with sufficient play to allow a specific opening of the pair of gripper claws against the force of the prestressing means irrespective of the position of the first operating lever; and further comprising a manual second operating lever having a first side piece and a second side piece, the first side piece adjacent to the first side of the first operating lever and the second side piece adjacent to the second side of the first operating lever each side piece having a recess for accepting the operating shaft, the second side piece having a linkage bore for accepting a linkage shaft operatively connected to the coupling linkage;

wherein the play is provided between the linkage shaft and the first operating lever, and the manual second operating lever can be pivoted about the operating shaft of the first operating lever in the opening direction and within the play using a handle attachment for manual operation of the second gripper claw member.

2. A gripper mechanism according to claim 1, wherein the first and second side pieces of the manual second operating lever engage around the gripper arm and sit on the operating shaft acting as an intermediate bearing between this and axially adjacent first operating lever.

3. A gripper mechanism according to claim 1 wherein the first and second side pieces of the manual second operating lever include a sleeve in the linkage bore used as an intermediate bearing between the linkage shaft and the first operating lever.

4. A gripper mechanism according to claim 2 wherein the first and second side pieces of the manual second operating lever each include a sleeve, which sleeve projects axially outwards and passes through between the said linkage shaft and a respective bearing recess in the first operating lever, wherein the sleeve includes a free end attachment for interacting with stop means on the linkage shaft.

5. A gripper mechanism according to claim 4, wherein the linkage shaft is connected to the coupling linkage and has an outer end that includes a spring action point for connecting prestressing means comprising helical tension springs that are stretched to a second spring action point on the gripper hand wherein the spring action point on the linkage shaft form stop means which interact with the free end attachment.

6. A gripper mechanism according to claim 2, wherein the first and second side pieces of the manual second operating lever each include a U-shaped cutout for engaing the operating shaft and open away from the linkage shaft and open radially outwards.

7. A gripper mechanism according to claim 1, wherein the manual second operating lever is disposed to one side of the gripper arm.

8. A gripper mechanism according to claim 1, wherein the manual operating lever includes high-strength, tough plastic material having bearing surface characteristics comparable to metal machine parts.

9. A gripper mechanism according to claim 1, wherein the manual operating lever includes injection molded material.

* * * * *